United States Patent [19]

Johnson

[11] 4,213,410

[45] Jul. 22, 1980

[54] ADJUSTABLE HOOK FOR A SEWING MACHINE

[75] Inventor: Ralph E. Johnson, Convent Station, N.J.

[73] Assignee: The Singer Company, Stamford, Conn.

[21] Appl. No.: 19,068

[22] Filed: Mar. 9, 1979

[51] Int. Cl.[2] ..... D05B 57/14

[52] U.S. Cl. ..... 112/228

[58] Field of Search ..... 112/181, 182, 184, 191, 112/228, 230, 231

[56] References Cited

U.S. PATENT DOCUMENTS

| | | | |
|---|---|---|---|
| 2,296,661 | 9/1942 | Graesser | 112/228 X |
| 2,851,977 | 9/1958 | Spaine | 112/181 X |
| 2,866,425 | 12/1958 | Palmbach | 112/228 X |
| 3,090,335 | 5/1963 | Bono | 112/231 |
| 3,390,653 | 7/1968 | Ketterer | 112/228 |
| 3,407,760 | 10/1968 | Ketterer | 112/184 |
| 3,465,700 | 9/1969 | Kuhar | 112/228 |
| 3,490,402 | 1/1970 | Ketterer | 112/184 |
| 3,949,690 | 4/1976 | Weisz | 112/184 |

FOREIGN PATENT DOCUMENTS

| | | | |
|---|---|---|---|
| 1166541 | 11/1958 | France | 112/181 |

*Primary Examiner*—Wm. Carter Reynolds

*Attorney, Agent, or Firm*—William V. Ebs; Robert E. Smith; Edward L. Bell

[57] ABSTRACT

A sewing machine hook is provided with a hook body which can be adjusted relative to a drive shaft both along a radial line extending from the axis of the shaft through the hook beak and circumferentially about such axis to properly position the hook beak for seizing a loop of thread from a sewing needle.

2 Claims, 5 Drawing Figures

Fig. 1
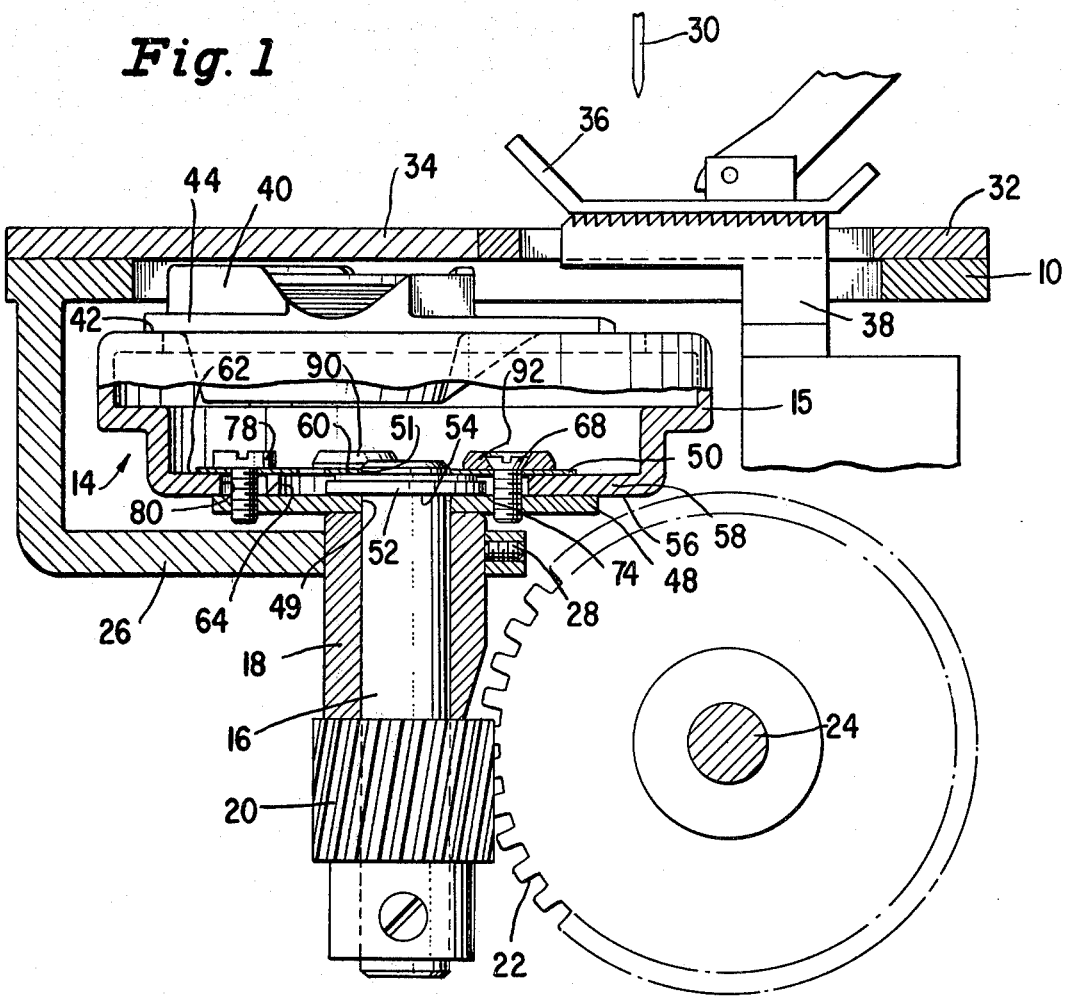
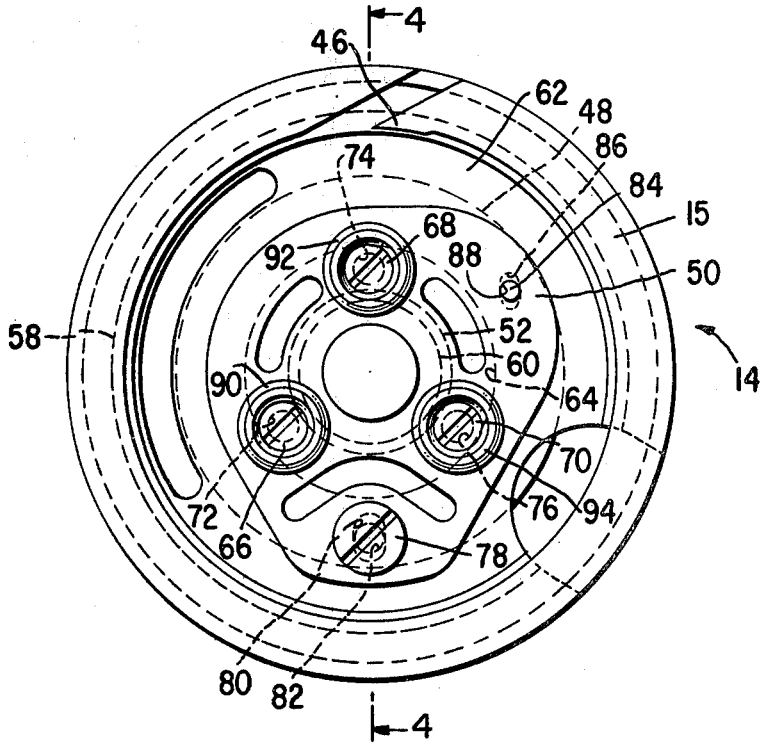
Fig. 2

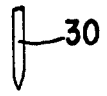
Fig. 4
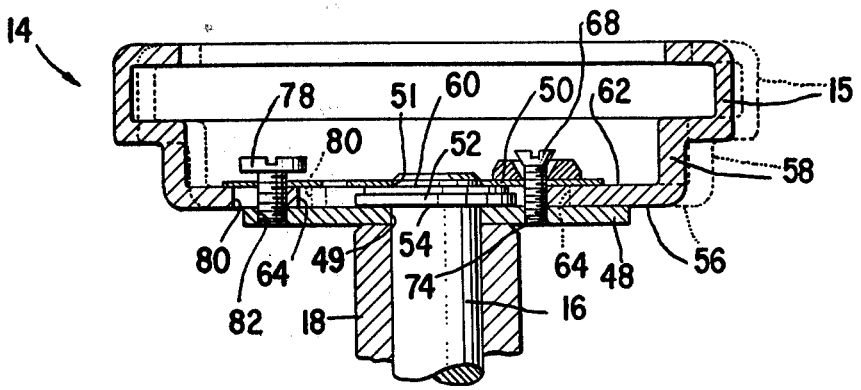
Fig. 5
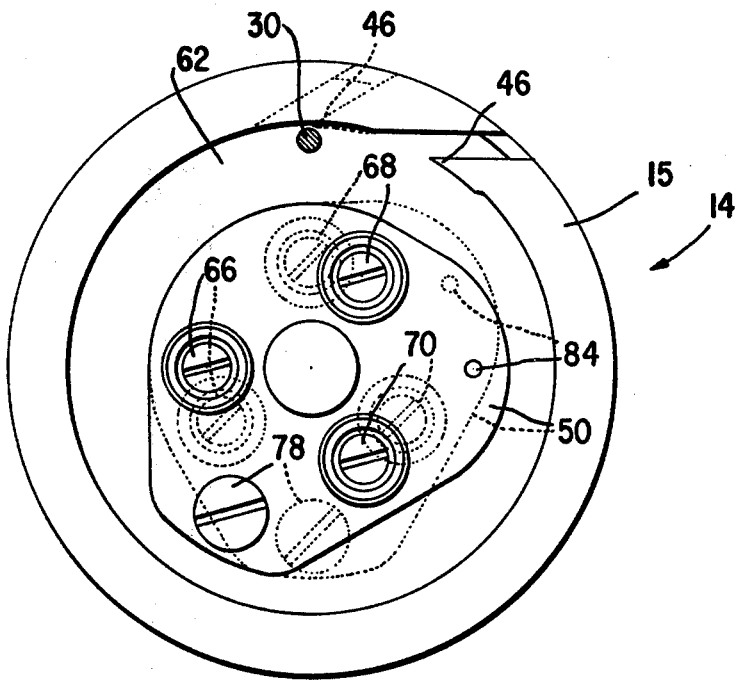

ADJUSTABLE HOOK FOR A SEWING MACHINE

DESCRIPTION

BACKGROUND OF THE INVENTION

1. Field of the Invention

The invention relates to rotating loop takers or hooks including a hook beak for seizing a loop of needle thread in a sewing machine.

2. Description of the Prior Art

It is well known that the loop seizing beak of a sewing machine hook must pass closely adjacent to the sewing needle to seize the loop of thread therefrom, and must pass the needle in a precise predetermined timed relation thereto to assure proper stitch formation. Machines have been variously constructed to permit one adjustment to be made effective to locate the hook beak relative to the needle for loop seizing, and another adjustment to be made effective to properly time movement of the hook beak with respect to the needle. In general, each adjustment had to be made at a separate location in the machine and the adjusting means have not been readily accessible, at least to one desiring to effect such adjustments in a completely assembled machine having enclosing covers in places.

SUMMARY OF THE INVENTION

In accordance with the invention, the body of a hook is rendered adjustable along a radial line extending from the axis of the drive shaft therefor to the hook beak such that the hook beak may be properly positioned relative to a needle for loop seizing, and is rendered circumferentially adjustable about said axis such that the hook beak movements may be accurately timed with respect to the needle. Plates are provided for clamping the hook body, when suitably adjusted, to the drive shaft. One plate is made rigid so that it may serve to define a plane of rotation for the hook beak, and the other plate is made of a flexible material so that it may readily be drawn tightly at several locations against opposing surfaces on the hook body and a fixed flange on the drive shaft.

DESCRIPTION OF THE DRAWINGS

FIG. 1 is a fragmentary vertical sectional view taken transversely through the bed of a sewing machine and the axis of a hook constructed according to the invention;

FIG. 2 is a top plan view of the hook of the invention;

FIG. 4 is a vertical sectional view taken on the plane of the line 4—4 of FIG. 2, and showing the hook body in different radial positions with respect to the hook drive shaft axis;

FIG. 5 is a top plan view of the hook showing the hook body in different angular positions relative to the hook drive shaft.

DESCRIPTION OF THE PREFERRED EMBODIMENT

Figure 3:
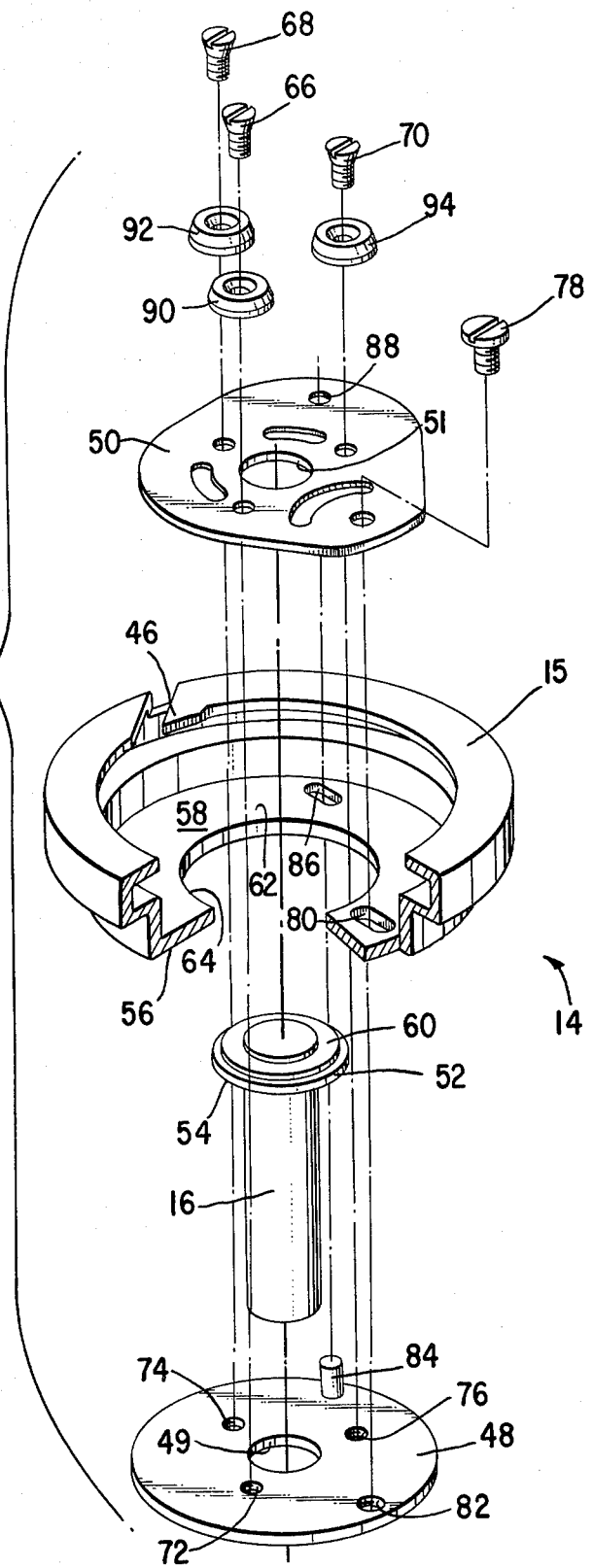
FIG. 3 is an exploaded perspective view of the hook.

Referring to the drawings, reference character 10 designates a portion of the bed of a sewing machine wherein the hook 14 of the invention is rotatable mounted. The hook includes a hook body 15 and shaft 16. Shaft 16 extends through a bushing 18 and has a worm gear 20 secured thereon which meshes with and is driven by a gear 22 mounted on the bed shaft 24 of the machine. As shown the bushing 18 is supported in the bed on a web 26 to which the bushing is affixed by a screw 28. Reference character 30 designates a sewing needle with which the hook 14 cooperates and which is reciprocated endwise by conventional actuating mechanism. The usual removable throat and slide plates 32 and 34 respectively are provided to support work being sewn under a presser foot 36. Feed dog mechanism 38 is provided to advance the work.

The hook body 15 is cup-shaped and receives a bobbin case 40. The hook body is formed with a flat bearing surface 42, and the bobbin case is formed with a flange 44 that extends part way therearound. Flange 44 rests on bearing surface 42 as shown. A bracket, which is not shown in accompanying drawings, but which may of the type disclosed is U.S. Pat. No. 3,373,707 of The Singer Company, is carried in the bed and supports bobbin case locating means that engages the bobbin case flange to constrain the bobbin case radially, angularly and axially of the hook body.

Hook 14 is provided, in accordance with the invention, with clamping means which when tightened affixes the position of the hook body with respect to the shaft axis, and which when loosened permits the hook body to be moved so as to position a hook beak 46 on a radial line extending from the shaft axis substantially through the needle 14 or to position the hook beak circumferentially about the shaft axis with respect to the needle. The clamping means includes a rigid plate 48 and flexible plate 50. Shaft 16 extends through central openings 49 and 51 in the rigid and central plates 48 and 50 respectively, and includes as an integral part thereof an upper end portion in the form of a stepped flange 52. Plate 48 engages the underside 54 of flange 52 and the underside 56 of a bottom flange 58 formed on hook body 15. Flexible plate 50 bears against top side 60 of flange 52 and against the top side 62 of hook body flange 58. The hook body flange includes a large central opening 64, and screws 66, 68 and 70 extend through flexible plate 50 and the central opening 64 in the hook body flange 58 to engage threaded holes 72, 74 and 76 respectively in rigid plate 48. A screw 78 extends through flexible plate 50 as well as through an elongated hole 80 in hook body flange 58 to engage a threaded hole 82 in rigid plate 48, and an upwardly projecting pin 84 on plate 48 extends through an elongated hole 86 in hook body flange 58 and into a mating hole 88 in flexible plate 50.

The central openings in rigid plate 48 and flexible plate 50 permit the plates to be moved in a rotational sense when screws 66, 68 and 70 are loose, but do not permit any substantial degree of radial movement of the plates relative to the shaft axis. Screws 78 and pin 84 prevent rotational movement of the hook body 15 relative to plates 48 and 50, even when the screw 78 is loose. When the various screws 66, 68, 70 and 78 are loose, sliding movement of the hook body on the plates in a radial direction with respect to the shaft axis along a line extending thereform substantially through the hook beak 46 is possible. The permitted direction of movement is established by elongated hole 80 which extends in the direction of said radial line and by elongated hole 86 extending parallel to hole 80.

The hook body 15 is readily adjusted radially and circumferentially to position the hook beak relative to needle 30 for loop seizing without the necessity of removing enclosing panels of a machine. It is only necessary to remove slide plate 32 from the bed of the machine so as to permit an unobstructed view of the hook beak 46 in relation to the needle 30. The hook body is adjusted radially by hand as between the solid and dotted line positions in FIG. 4 while screws 66, 68, 70 and 78 are loose, and with the hook beak 46 at the needle 30 where it may be located with the hand wheel of the machine. The hook body is properly adjusted radially when the hook beak is so disposed that it can pass the needle in very close proximity thereto without being hit by of the beak. When the hook beak position relative to the needle is correct, screw 78 on the opposite side of the shaft axis from the hook beak is tightened to fix the position of the hook body with respect to plates 48 and 50. After the hook body has been radially adjusted it is manually adjusted circumferentially, as from the solid line position to the dotted line position in FIG. 5, to time the hook beak. Such timing is accomplished by disposing the hook beak so that it will just barely pass above the eye of the needle 30 as the needle moves upwardly. Once the hook beak has been properly timed, screws 66, 68 and 70 are tightened to clamp plates 48 and 50 against opposite sides of the hook body flange 58 as well as against the underside 54 and top side 60 respectively of flange 52 so as to establish a positive driving connection between the shaft 16 and hook body 15. Collars 90, 92 and 94 provided on the screws 60, 68 and 70 respectively engage flexible plate 50 and thereby serve to effectively apply the clamping force thereto.

It is to be understood that the present disclosure relates to a preferred embodiment of the invention which is for purposes of illustration only, and that various modifications may be made therein without departing from the spirit and scope of the invention as defined in the appended claims.

I claim:

1. In combination, a sewing machine hook including an adjustable hook body with a beak for seizing a loop of needle thread and a bottom flange with a central opening therein, a shaft which extends through the opening, a pair of clamping plates axially and radially restrained on the shaft, the plates being disposed in sliding contact with opposite sides of the hook body flange bottom to permit radial and circumferential adjustments of the hook body relative to the shaft axis when unclamped, and means for tightly clamping the plates to the hook body flange and shaft for affixing the hook body and beak in an adjusted position with respect to the shaft axis, the means for clamping the plates to the hook body flange including a fastener to secure the hook body and hook beak in a radially adjusted position, and other fasteners to establish a positive driving connection between the hook body and shaft, one of the plates having a pin thereon, and the hook body flange including parallel elongated slots which receive the pin and said first mentioned fastener to guide radial adjusting movements of the hook body.

2. The combination of claim 1 wherein the elongated slots provide for adjusting movements along a radial line extending from the shaft axis at least substantially through the hook beak.

* * * * *